United States Patent [19]

Boker

[11] Patent Number: 4,910,809

[45] Date of Patent: Mar. 27, 1990

[54] TOILET SEAT COVERING

[75] Inventor: Samuel J. Boker, Bayside Queens, N.Y.

[73] Assignee: Sani-Tech Industries Inc., Hicksville, N.Y.

[21] Appl. No.: 173,835

[22] Filed: Mar. 28, 1988

Related U.S. Application Data

[62] Division of Ser. No. 871,230, Jun. 6, 1986, Pat. No. 4,766,618.

[51] Int. Cl.[4] ..... A47K 13/22

[52] U.S. Cl. ..... 4/247; 264/146

[58] Field of Search ..... 4/247, 242; 428/76, 428/192, 358; 264/146, 177.14

[56] References Cited

U.S. PATENT DOCUMENTS 3,034,941 5/1962 Hessenthaler et al. ..... 428/192 X
4,235,653 11/1980 Ausnit ..... 383/63 X
4,381,273 4/1983 Azzola ..... 428/358 X
4,690,412 9/1987 Tuckley et al. ..... 428/358 X
4,699,837 10/1987 Bright ..... 428/358 X

FOREIGN PATENT DOCUMENTS 0167348 9/1984 Japan ..... 428/101

*Primary Examiner*—Charles E. Phillips
*Attorney, Agent, or Firm*—Leonard Belkin

[57] ABSTRACT

Apparatus for supplying a toilet seat with fresh and sanitary cover material and taking up the used material. The cover material is folded lengthwise and is dispensed from a supply reel to one terminus of the seat. The material encircles the body of the seat and a take-up reel at the other terminus of the seat takes up the used material and at the same time pulls in fresh material. Both termini of the seat are attached to and spaced from the toilet bowl. The seat is provided with a slot to guide the material which is provided with beads along its edges to ride within the slots.

5 Claims, 4 Drawing Sheets

TOILET SEAT COVERING

This application is a division of my application Ser. No. 871,230 filed on June 6, 1986 now U.S. Pat. No. 4,766,618.

BACKGROUND OF THE INVENTION

The present invention relates to a toilet seat covering and more particularly to a toilet seat covering which is automatically replaced upon command.

In U.S. Pat. No. 4,213,212 issued to Hefty et al there is a brief discussion of the state of the art of applying hygienic covers to toilet seats. The patent describes a variety of earlier arrangements covered by German patents and discloses and claims an arrangement for dispensing from a supply reel a tubular plastic to feed on one end of a toilet seat to be pulled the length of the toilet seat and then wound upon on a take-up reel from the other end for last disposition.

The arrangement of Hefty et al requires that one end of the horseshoe spaced toilet seat be free, or in effect, floating, in order for the tubular plastic material being dispensed to be fed onto and surround the seat itself. The necessity for surrounding the seat is dictated by the need to insure that the plastic covering will not fall off the top of the seat, a problem generally associated with previous such devices as described by the patentees.

Several drawbacks are associated with the device described in the patent. The presence of a free end of the horseshoe shaped seat can interfere with the movement of the tubular plastic material from the supply reel if the free end is inadvertently or intentionally pulled away from the top of the commode. Furthermore, when a child uses the seat there could be a safety hazard because the free end makes it possible for a limb to be caught between the free end and the commode. In addition, the exposed knife edge which is required at the other end of the seat to slit the plastic tubing to permit egress from the seat for winding on the take-up reel is a safety hazard as well. An exploratory poking of a finger into the region where the blade is located could very well result in a serious injury and bleeding. Other potential problems can be caused by twisting of the plastic on the seat resulting in jamming of the device, or tearing of the plastic which can result in a total failure of operation.

SUMMARY OF THE INVENTION

This invention completely overcomes or substantially reduces the problems and drawbacks associated with earlier and existing toilet seat covers and provides additional advantages not found in such earlier arrangements.

In the present invention, there is provided an arrangement for automatically replacing a toilet seat covering prior to use, said arrangement being simple to use, is reliable and relatively foolproof in operation, more economical than such devices heretofore in use, and avoids safety hazards associated with earlier devices.

In one preferred embodiment of the invention, the apparatus comprises a toilet seat, a reel for supplying folded unused cover material to said seat for enclosing the contact surface of said seat, and a take-up reel for taking up used cover material after transversing the length of the seat. The seat is provided with an arrangement for joining the edges of the cover material and making positive engagement with the cover material for guiding the movement of the cover material along its length and preventing twisting of the material along the length of the seat.

Other features of the invention include provision for advancing the cover material no more than is required to completely replace the used material, and insure movement of the material even when a substantial portion of the material is torn or damaged.

In other embodiments of this invention there is provided a beaded plastic sheet material for use as the cover material on a toilet seat and method for forming said sheet material.

It is therefore a principal object of this invention to provide improved apparatus for replacing toilet seat covering material with unused material overcoming many of the problems and deficiencies associated with prior art devices.

Another object is to provide improved toilet seat covering material and a method for preparing said material.

Other objects and advantages of this invention will hereinafter become obvious from the following detailed description of preferred embodiments of this invention.

DETAILED DESCRIPTION OF THE PREFERRED EMBODIMENT

Figure 1:
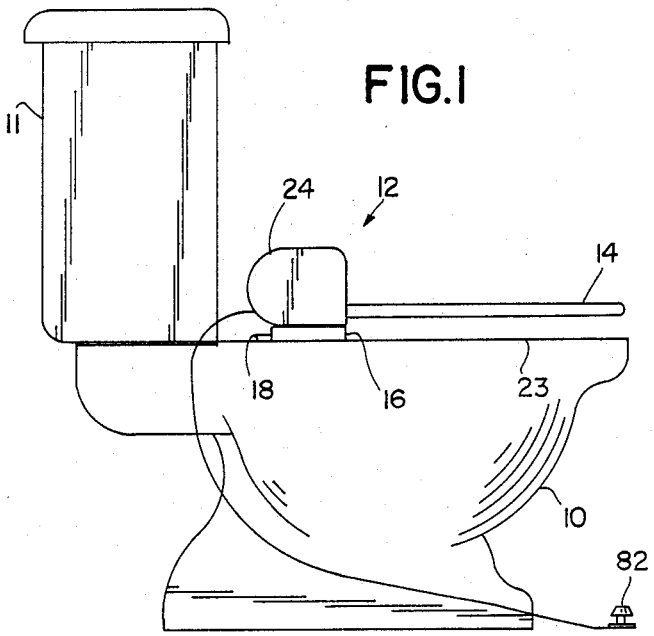
FIG. 1 is an elevation side view of a commode or toilet bowl incorporating a preferred embodiment of the toilet seat of this invention.
Figure 2:
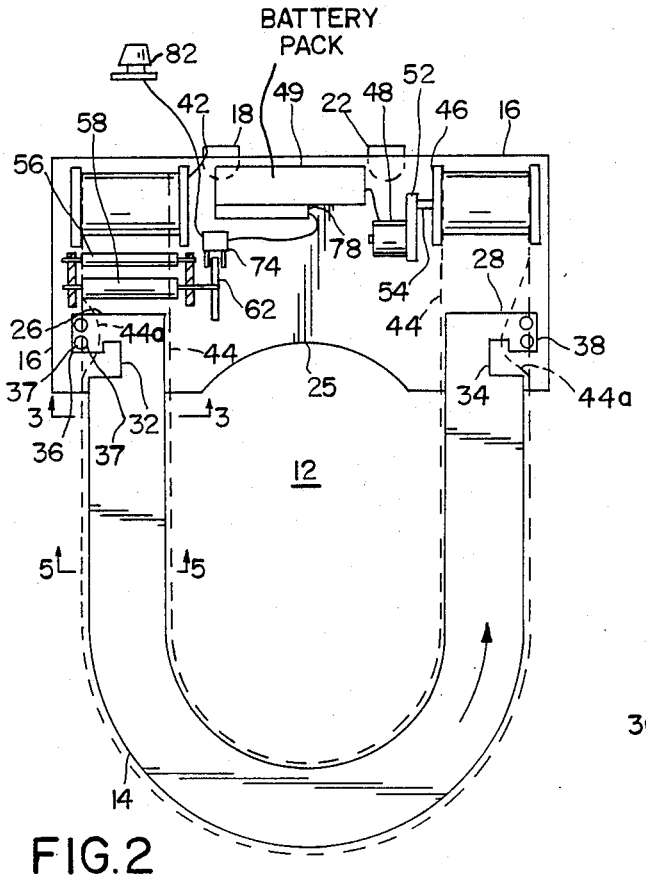
FIG. 2 is a plan view of the toilet seat shown in FIG. 1 with the housing removed.
Figure 1A:
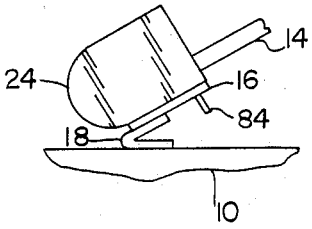
FIG. 1*a* shows the toilet seat in a raised position.

Referring to FIGS. 1 and 2 there is illustrated a conventional toilet bowl 10 with a rearwardly mounted flush tank 11, and apparatus 12 embodying the principles of this invention. Apparatus 12 includes a toilet seat 14 shown in FIG. 1 and in its partially raised position in FIG. 1*a* attached to a plate 16, and pivoted by hinges 18 and 22 mounted on base 23. A housing 24 encloses the mechanism of the apparatus. Apparatus 12 can be designed as a unit to replace the standard toilet seat found on toilet bowls. Plate 16 is generally rectangular in configuration with a concave section 25 to conform to the shape of bowl 10 while the outline of housing 24 will generally follow the shape of plate 16 so that everything mounted on the latter will be fully enclosed. The rear of housing 24 is curved or circular to facilitate pivoting of the assembly of seat 14, plate 16, and housing 24.

Figure 3:
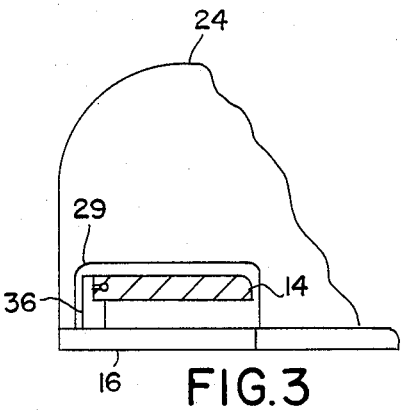
FIG. 3 is a section along 3—3 of FIG. 2 with the housing in place.

Referring in particular to FIG. 2, it will be seen that toilet seat 14 has a generally ring-like configuration shaped like a horse shoe with its termini 26 and 28 overlapping base 16. Adjacent terminus 26 there is a generally L-shaped cutout 32 in seat 14, while an oppositely facing similar cutout 34 is provided adjacent terminus 28. Termini 26 and 28 and cutouts 32 and 34 would in the normal installation of apparatus 12 be enclosed in their housing 24 and not be visible. As seen in FIG. 3, housing 24 is provided with an opening 29 for seat 14 on one side while there would be a corresponding opening on the other side for the other leg of seat 14.

Termini 26 and 28 of seat 14 are supported on plate 16 by a pair of identical members 36 and 38 which could be an integral part of seat 14 to insure that the exposed termini 26 and 28 are spaced above and do not contact plate 16. As also seen in FIG. 3, member 36 may be attached to plate 16 with screws 37 to maintain the spacing noted above. Member 38 performs a similar function at the other terminus of seat 14.

A supply reel 42 for fresh cover material 44, preferably a plastic film, is mounted in any convenient fashion on plate 16 opposite terminus 26 to fed material 44 over the body of seat 14 as illustrated in Fig. 2. The material is moved in the direction as indicated by the arrow and a take-up reel 46 mounted on base 16 opposite terminus 28 collects the used material. An electric motor 48 powered from a battery pack 49, as will be later more particularly described, provides the drive for take-up reel 46 through a stepdown gearing assembly or transmission 52 and a shaft 54, of conventional design.

Figure 4:
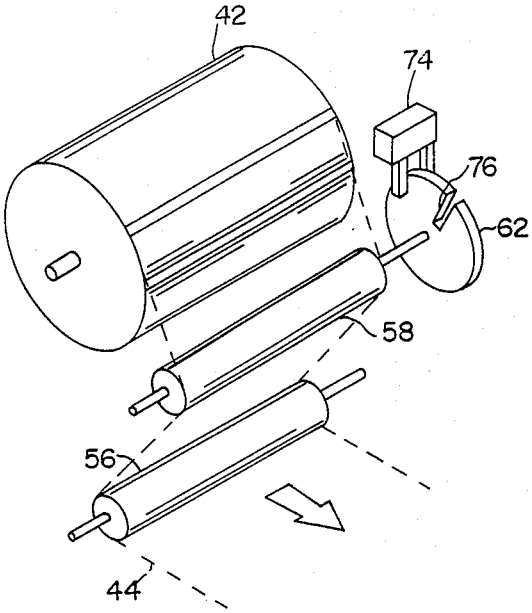
FIG. 4 is a schematic illustration of the supply reel with its idlers.

It will be noted in connection with supply reel 42 there are provided a pair of idlers 56 and 58, which as shown in FIG. 4, are designed to exert some tension on cover material 44 to avoid slack as it comes off reel 42. One or both of idlers 56 and 58 may be spring mounted, if desired or needed, to insure the proper tension. Attached to rotate with roller 58 is a disk 62 whose function will be described below.

Figure 5:
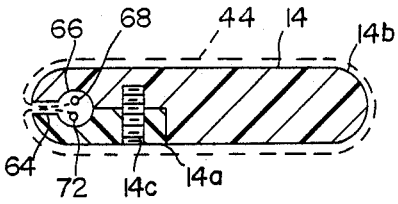
FIG. 5 is a view along 5—5 of FIG. 2.
Figure 6:
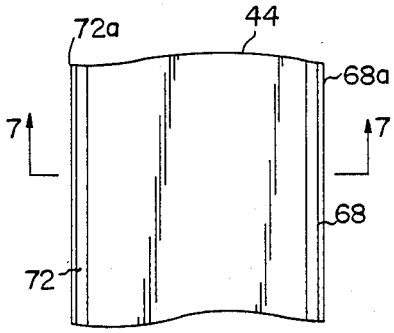
FIG. 6 is a plan view of a portion of the covering material before folding.
Figure 7:
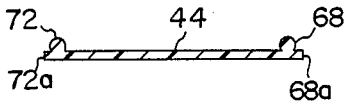
FIG. 7 is a view along 7—7 of FIG. 6.
Figure 9:
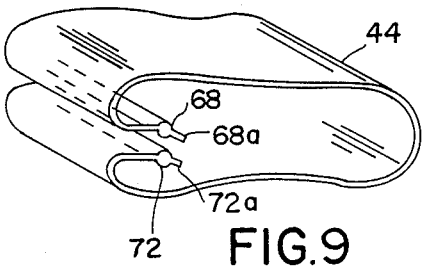
FIG. 9 is a partially expanded, isometric view of the covering material as folded for use on the supply reel.

As seen in FIG. 5, seat 14 is provided along its outer rim or circumference with a slot 64 terminating in a well 66. The body of seat 14, which can be constructed at separate parts 14*a* and 14*b* to form slot 64 and well 66, is shown surrounded by cover material 44 whose edges pass through slot 64 and terminate in a pair of beads 68 and 72 trapped within well 66. As can be seen in FIGS. 6 and 7, cover material 44 is a plastic sheet material of suitable thickness whose edges terminate in beads 68 and 72 with short tails 68*a* and 72*a*,l respectively. On supply reel 42, material 44 is folded in the manner illustrated in FIG. 9 for ease of dispensing on to seat 14 as will now be described. Parts 14*a* and 14*b* of seat 14 can be joined by any convenient means such as screws 14*c*.

Figure 8:
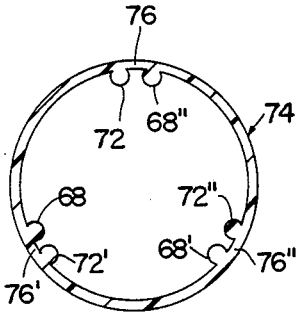
FIG. 8 is a section view of the cover material in tubular form prior to slitting.

Referring to FIGS. 6 and 7, plastic sheet material 44 is provided with beads 68 and 72 extending along and adjacent the edges of the material with tails 68*a* and 72*a*. One way of preparing material 44 is illustrated in FIG. 8 where it is seen that tubing 74 which may be extruded is provided internally with pairs of spaced beads 68 and 72, 68' and 72', and 68" and 72". By slitting tubing 74 at 76, 76' and 76" it can be seen that several extended sheets of cover material can be prepared from a single tube 74.

On the other hand, if desired, sheet material 44 shown in FIG. 6 can be extruded directly in the shape shown.

Figure 10:
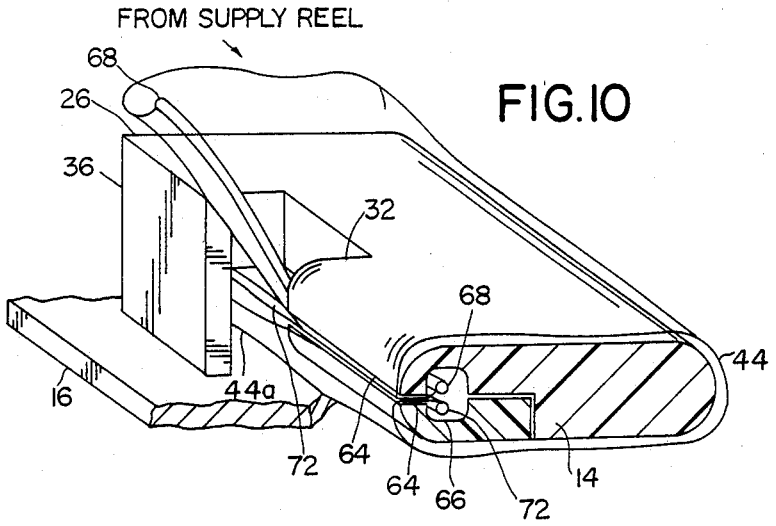
FIG. 10 is an iosmetric view in partial section of the take-up terminus of the toilet seat with the covering material being fed.

Referring to FIG. 10, it is seen that the folded covering material 44 having egressed from supply reel 42 and idler rollers 56 and 58, spearate to pass above and below terminus 26 of seat 14. The bottom portion 44a curves away to get by member 36 as seen in FIGS. 2 and 10. Slot 64 and well 66 terminate at cutout 32 where beads 68 and 72 of material 44 enter well 66, so that when take-up reel 46 is actuated, material 44 is pulled around and there is a continuous feed of beads 68 and 72 into well 66.

At terminus 28 where cover material 44 is leaving seat 14, the reverse occurs, with beads 68 and 72 leaving seat 14 at cutout 34 and the folded material 44 is wound for later disposal.

Advantages of this arrangement for feeding and taking up the material are immediately evident. Since it is the beads along the edges of the material which effectively accomplish the pulling of the material along the seat, any tearing of the covering material will not prevent operation of the device, as may occur in previous designs involving movement of the material along the seat. In addition, since the beads are trapped in a well, no twisting of the material is possible. In some other arrangements, rough usage of the seat between movements of the material could cause some twisting with jamming of the apparatus. Also, as the material along the outer edge of the seat must move a greater distance than material along the inner edge, in some arrangements this could also result in jamming of the apparatus. In the present arrangement, all of these problems are avoided.

This invention also embodies features designed to render it more difficult in terms of use of the material. Referring back to FIG. 2, there is shown mounted on plate 16 an encoder 74 enclosing the outer periphery of disk 62 which would be provided with a slot 76 (See FIG. 4) permitting encoder 74 to count each revolution of roller 58. Encoder 74 is connected to a printed circuit (PC) board 78 containing circuitry to count the revolutions of roller 58 thereby measuring the exact length of fresh material 44 to replace that which has been used. Roller 58 may be provided with a rubber or other high friction material to prevent slipping of the plastic material. Foot switch 82 wired to PC board 78 upon actuation initiates the cycle of replacing used covering material on seat 14 by energizing motor 48. After disk 62 has made sufficient rotations to provide the full replacement, but no more, of used material, PC board 78 will terminate actuation of motor 48. Seat switch 84 as seen in FIG. 1 extending from the bottom of seat 14 to contact base 23 is employed to insure that actuation of the mechanism will not occur unless seat 14 is up.

It should be noted that in some previous arrangements, material movement is governed by rotation of the supply reel. Since the diameter of the wound reel changes as the supply is used up, it can be seen that during a good portion of the cycles, excess material is used with a great deal of extra expense involved, both in the amount of material being used and in frequency of service which is required.

EXAMPLE

Figure 11:
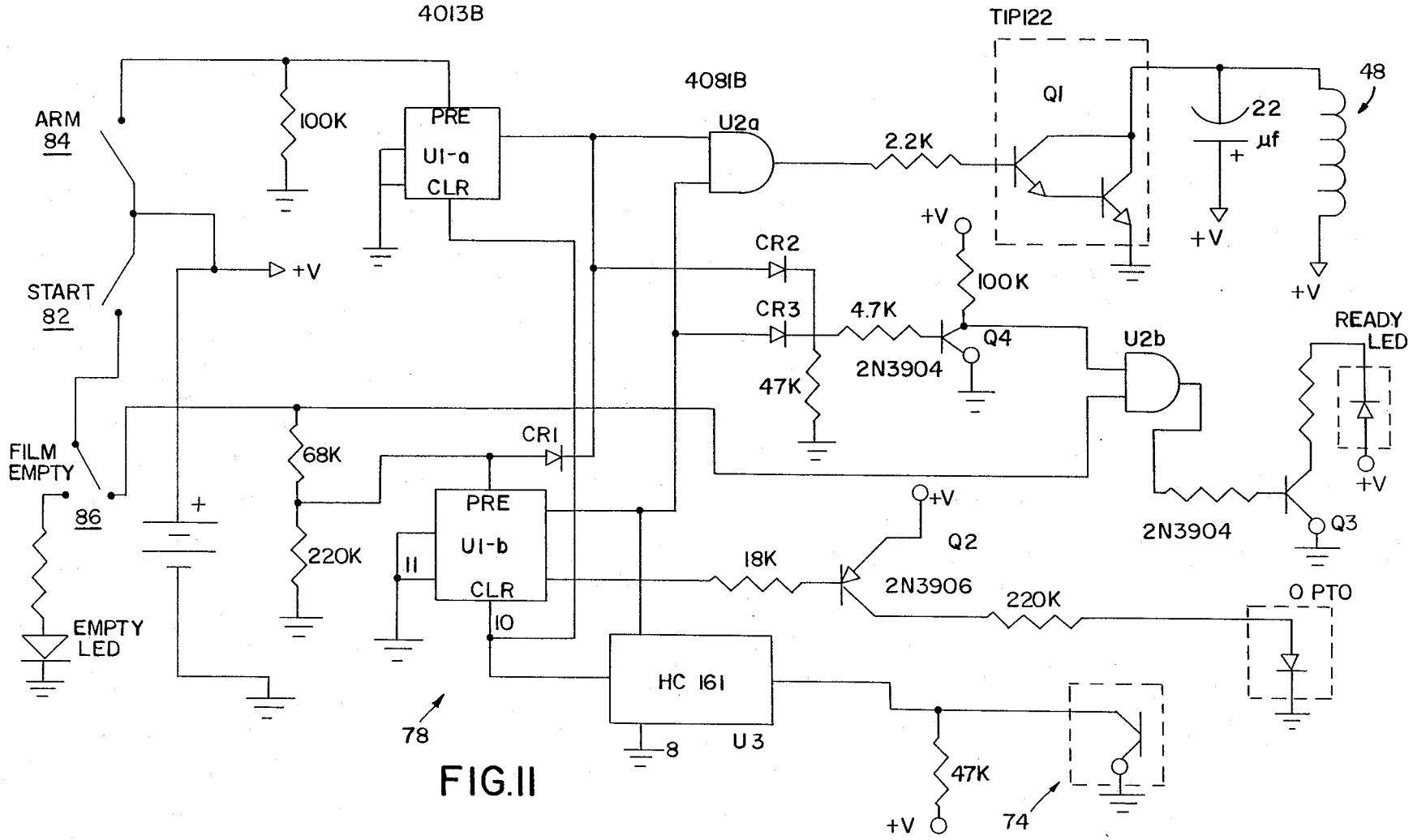
FIG. 11 is a schematic for the control board.

An example of encoder 74 and circuit board 78 used successfully is illustrated in FIG. 11. Encoder 74 is a photon coupled interrupter module H21A1 available in the industry. It utilizes a gallium infrared emitting diode coupled to a silicon photo transistor so that the latter is actuated on each cycle as slot 76 on disk 62 passes an infrared emitting diode.

Circuit 78 contains all the necessary electronics to control the movement of a section of material 44 around the seat. The two section U1*a* and U1*b* (4013B) form a sequence memory. If the seat switch 84 has been pressed, the Q output of U1-*a* is set high. This enables the gate U2a(408B). In addition, this also frees the present input of U1*b* via diode CR1 to allow U2*b* to preset when switch 82 is pressed. Switch 82 will only set U2*b* if U1a has already been preset (due to CR1).

When both Q outputs have been set high (by pressing switches 84 and 82, the AND gate U1a output will go high. This turns on the darlington transistor Q1M (TIP122) which turns on motor 48.

While motor 48 is on, Q2 (2N3906) enables the power to the slotted optical detector (OPTO) on encoder 84. This is done to conserve battery power. The mechanical interrupter causes a series of pulses to occur at the collector of the detector. These pulses go into a divide by 16 counter U3. After sixteen pulses the counter overflows and resets the sequence memories U2*a* and U2*b* which turns off motor 48. This completes the cycle.

If a cycle has been completed, both Q outputs for U1 will be too low. This is detected by CR2 and CR3 and Q4. If the start switch 82 is now pressed, U2-*b* gate will turn on the READY LED via Q3. Motor 48 will not start in this mode.

If the FILM EMPTY switch 86 detects the roll is finished, it will apply power to the EMPTY LED whenever the START switch is pressed, indicating a new roll of film is needed. Optional switch 86 is not shown elsewhere.

The circuit shown in FIG. 11 is made up of commercially available integrated circuits and components which are identified.

In the operation of the apparatus described, the prospective user of the toilet wil step on foot operated start switch 82 while seat 14 is in the up position which will initiate the operation of motor 48 to begin the rotation of take-up reel 46. Encoder 74 will insure that just sufficient material will be wound on reel 46 to fully replace, from supply reel 42, all of the used material on seat 14.

With housing 24 in place, as seen in FIG. 2, it should be noted that there could be some contact between the user of toilet 10 and the front of housing 24. Some soiling could take place with the result that there could be concern about the total hygienic environment of the apparatus.

Figure 12:
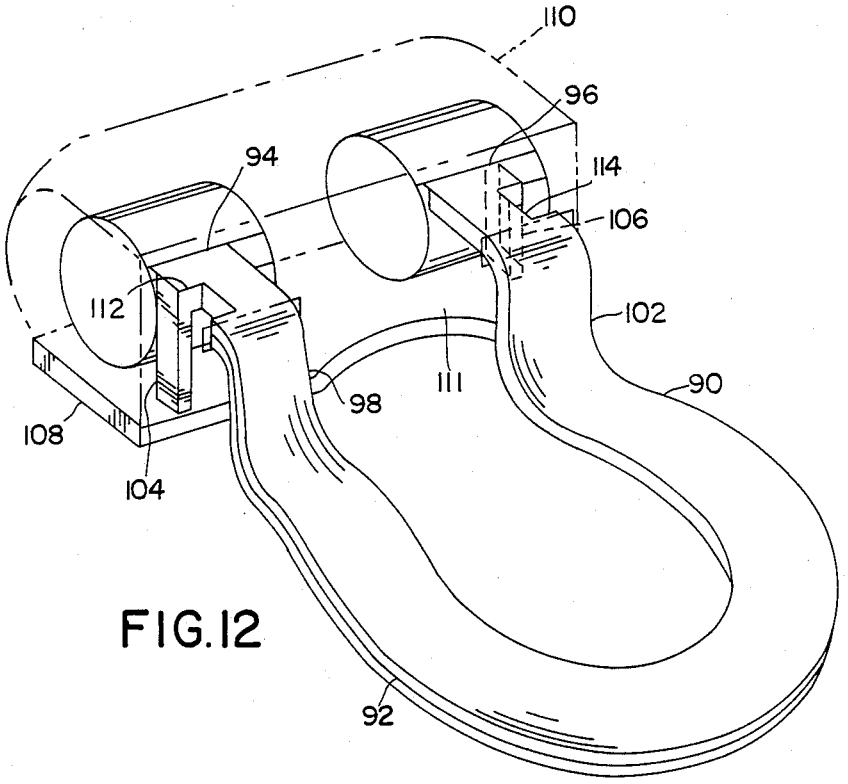
FIG. 12 is an isometric view of an alternative embodiment of the toilet seat.

In an alternative embodiment of this invention, that problems can be avoided by changing the shape of the seat as seen in FIG. 12. There, seat 90 having a similar annular slot 92 with the well (not shown) is provided with termini 94 and 96 raised substantially above the level of the remainder of seat 90 by sloping sections 98 and 102. Elongated members 104 and 106 support seat 90 from base plate 108. However, it is seen that in this configuration, the user of seat 90 is prevented from contacting housing 110 with his backside by sloping sections 98 and 102. A pair of cutouts 112 and 114, as before, provide entry to the annular slot 92 and its well. As in the arrangement of FIG. 1, cutouts 112 and 114 are contained within housing 110. Housing 110 is rounded along its back surface to permit the use of hinges (not shown) for raising toilet seat 90, housing 110, and base plate 108. The remaining structure within housing 110 is the same as that which appears in the previously described configuration.

The use of an extended sheet of plastic material with beaded edges, folded as described, makes it possible to use this material most effectively with reduced cost, increased efficiency, and with greater safety. In the form described, it is believed that this plastic film material 44, and the methods of manufacture, as described could be useful in a variety of other applications where it might be desirable to fully enclose an extended member twisting is to be avoided or where the preparation of tubular material may be considered uneconomical.

Variations are possible without departing from the principles of this invention. Instead of the seat being shaped like a horse shoe, it can be oval or circular with cutouts appropriately located to reel in the cover material. By using slots and wells both along the inner and outer edges of the sheets, a sheet material covering only the top and side surfaces with beads entering both slots may be useful under certain circumstances.

Other ways of controlling the size of the feed could also be employed utilizing new technology as it develops, and cassettes may be substituted for the reels should that be desired. In any event, many changes and alternations are possible for those skilled in the art without departing from the principles of this invention as defined in the claims which follow.

What is claimed is:

1. A toilet seat cover in the form of an extended sheet of plastic material having beaded edges comprising only male type non-interlocking beads and folded lengthwise once down the center and second and third times, respectively, adjacent said beads with the latter folded into the space between the two folded sides, said extended sheet formed into a reel for dispensation as required.

2. The extended sheet of plastic material as recited in claim 1 wherein a tail extends from each beaded edge of said sheet.

3. The extended sheet of plastic material as recited in claim 1 wherein each bead extends up from one surface of said sheet parallel to and spaced from an edge of said sheet.

4. The extended sheet of plastic material as recited in claim 1 wherein said beads are formed on and extend up from one surface of said sheet.

5. The extended sheet of plastic material as recited in claim 4 wherein said beads are spaced from their respective edges.

* * * * *